United States Patent [19]

Koitabashi et al.

[11] 4,045,230

[45] Aug. 30, 1977

[54] LIGHT-SENSITIVE SUPER-SENSITIZED SILVER HALIDE COLOR PHOTOGRAPHIC MATERIALS

[75] Inventors: Takeo Koitabashi; Hideo Akamatsu; Noboru Fujimori, all of Hino, Japan

[73] Assignee: Konishiroku Photo Industry Co., Ltd., Tokyo, Japan

[21] Appl. No.: 667,361

[22] Filed: Mar. 16, 1976

[30] Foreign Application Priority Data

Mar. 19, 1975 Japan ..... 50-33159

[51] Int. Cl.[2] ..... G03C 1/40; G03C 1/14

[52] U.S. Cl. ..... 96/100 R; 96/124

[58] Field of Search ..... 96/124, 137, 100

[56] References Cited

U.S. PATENT DOCUMENTS

| | | | |
|---|---|---|---|
| 3,348,949 | 10/1967 | Bannert et al. | 96/124 |
| 3,856,532 | 12/1974 | Thurston et al. | 96/124 |
| 3,932,186 | 1/1976 | Borror et al. | 96/124 |

*Primary Examiner*—J. Travis Brown

*Attorney, Agent, or Firm*—Bierman & Bierman

[57] ABSTRACT

A light-sensitive silver halide color photographic material comprising at least a support and a red-sensitive, silver halide-containing layer containing at least one sensitizing dye of the following general formula I General formula (I)

and at least one sensitizing dye of the following general formula II

General formula (II)

11 Claims, 1 Drawing Figure

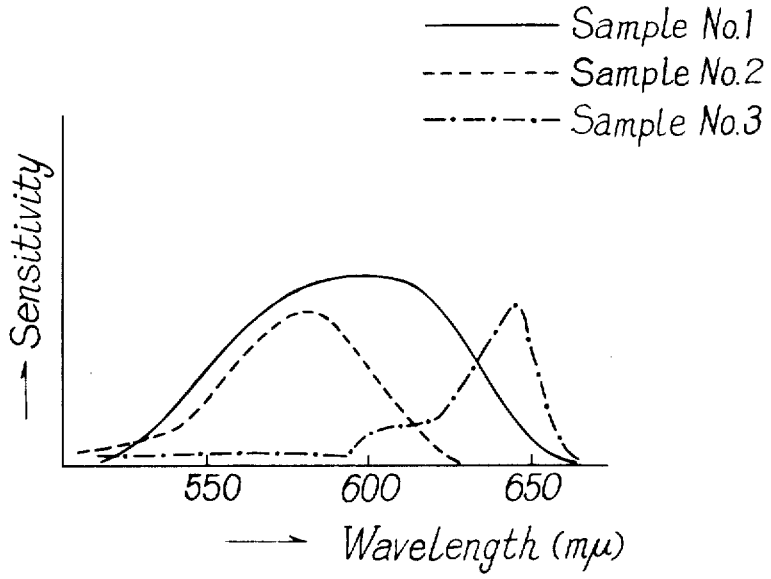
Sample No.1
Sample No.2
Sample No.3
Sensitivity
550
600
650
Wavelength (mμ)

LIGHT-SENSITIVE SUPER-SENSITIZED SILVER HALIDE COLOR PHOTOGRAPHIC MATERIALS

This invention relates to a light-sensitive silver halide color photographic material spectrally super-sensitized with a combination of two different kinds of sensitizing dyes, and particularly to a light-sensitive silver halide color photographic material, of which a spectral sensitization maximum of a red-sensitive layer among spectrally super-sensitized and multi-coated color photographic emulsion layers is between 600 and 630 mμ and said red-sensitive layer is high in red-sensitivity.

It has heretofore been known that when a silver halide emulsion is incorporated with a sensitizing dye, a sensitive wavelength zone thereof is expanded and thus the emulsion is optically sensitized. Further, in obtaining a desired spectral wavelength zone by spectrally sensitizing of silver halide emulsion, there are used in most cases mixtures of two or more kinds of sensitizing dyes, though only one kind of sensitizing dye is used in some cases.

Generally, however, when two or more sensitizing dyes are used in combination, it is usual that the spectral sensitivity thereby obtained is between or less than those obtained when the sensitizing dyes are individually used singly. However, the spectral sensitivity is sometimes markedly enhanced by the particular combination, and such phenomenon is commonly called spectral super-sensitization. In most of commercially available light-sensitive silver halide color materials, the spectral sensitization maximum of a red-sensitive layer thereof is at 635 to 670 mμ. On the other hand, the photographic characteristics of such light-sensitive silver halide color photographic materials are greatly affected by the kind of light source for the exposure of said materials. For this purpose, therefore, optimum color temperature to be employed for the exposure, is usually specified and the use of appropriate color temperature conversion filters is recommended for obtaining the optimum color temperature when a light source having a different color temperature is employed for the exposure. This is very inconvenient in photography. Therefore these drawbacks in light-sensitive silver halide color photographic materials heretofore used has been tried to be improved. For example, U.S. Pat. No. 2,343,424 discloses that for satisfactory color reproducibility regardless of fine weather or even rainy weather where the color temperatures thereof are different, spectral sensitization maximum of a red-sensitive layer of a light-sensitive silver halide photographic materials sensitized by use of sensitizing dyes should preferably be at 600 to 630 mμ. Further, as a process in which a practically satisfactory color reproducibility is obtained in light-sensitive silver halide color photographic materials when used for photographing under any light sources such as day light, tungsten light and light from fluorescent lamps without using any color temperature conversion filters, for example, Japanese Pat. Publication No. 6207/1974 discloses that specific spectral sensitization maximums of a blue-sensitive layer and a green-sensitive layer as well as a red-sensitive layer of light-sensitive silver halide color photographic materials for attaining the above purpose are required, and that particularly the spectral sensitization maximum of the red-sensitive layer is preferably at about 600 to about 630 mμ. In spite of the above-mentioned knowledge, it is still difficult to obtain practically satisfactory photographic materials in this respect for the following reasons:

a. When the spectral sensitization maximum of a red-sensitive layer of such light-sensitive silver halide color photographic material is made shorter by the use of a sensitizing dye in order to be between 600 to 630 mμ, the spectral sensitization thereof is low in degree,
b. Sensitizing dyes which spectrally sensitize the layer in the desired wavelength region, are very few in number, and if there are any, such dyes are low in sensitization degree,
c. When a sensitizing dye capable of sensitizing ability in such wavelength zone as mentioned above is used in a red-sensitive layer, undesired sensitization in green beyond red is so increased that the undesired sensitization cannot be compensated by insertion of a green light absorbing filter layer on the red-sensitive layer. This results in that the red-sensitive layer thus sensitized is found unsuitable for color photography, and
d. Even if a sensitizing dye capable of overcoming the foregoing drawbacks (a), (b) and (c) has become available, there are brought about such difficulties that deterioration of other photographic characteristics or change in the spectral sensitization maximum would occur in the course of manufacturing a light-sensitive silver halide color photographic material by incorporating such sensitizing dye into a color photographic emulsion or when the light-sensitive photographic material thus manufactured is stored for a long period of time, and thus many practical difficulties are involved therein.

Accordingly, an object of the present invention is to provide a light-sensitive silver halide color photographic material free of such drawbacks as mentioned above.

That is, the object of the present invention is to provide a light-sensitive silver halide color photographic material in which a combination of two different kinds of particular sensitizing dyes is used in a red-sensitive layer of said material so that suitable spectral sensitization maximum at 600 to 630 mμ may be attained in addition that red-sensitive layer possesses practically satisfactory high speed characteristics. Another object of the present invention is to provide a light-sensitive silver halide color photographic material in which a red-sensitive layer of a color photographic emulsion layer does not indicate any deterioration in photographic characteristics during the storage thereof and that no change in the spectral sensitization maximum takes place in the course of manufacturing the material. The present inventors have found that the above objects can be accomplished by incorporating into a red-sensitive layer of a multi-coated color photographic layer in a light-sensitive silver halide color photographic material at least one of sensitizing dyes represented by the following general formula (I) in combination with at least one of sensitizing dyes represented by the following general formula (II). General Formula (I)

General formula (I)

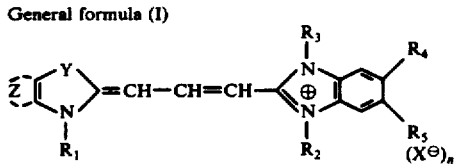

wherein Z is a group of non-metal atoms necessary to form a substituted or unsubstituted benzene or naphthalene ring; Y is sulfur of selenium; $R_1$ and $R_2$ are individually alkyl, sulfoalkyl, carboxyalkyl, alkoxyalkyl, hydroxyalkyl or aralkyl; $R_3$ is alkyl, acyloxyalkyl, aryl or aralkyl and at least one of $R_1$ and $R_2$ is carboxyalkyl or sulfoalkyl; $R_4$ is hydrogen or halogen; $R_5$ is trifluoroalkyl or trifluoroalkylsulfonyl; X is an anion and $n$ is 0 or 1, and an inner salt is formed when $n$ is 0.

General formula (II)

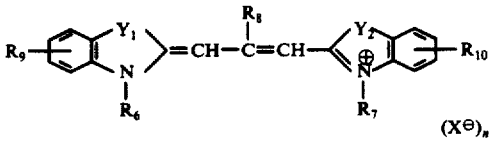

wherein $Y_1$ and $Y_2$ are individually sulfur or selenium; $R_6$ and $R_7$ individually represent a substituent selected from the same group as defined in $R_1$ and $R_2$; $R_8$ is lower alkyl; $R_9$ and $R_{10}$ are individually hydrogen, halogen, alkyl, alkoxy or aryl; X is an anion and $n$ is 0 or 1, and an inner salt is formed when $n$ is 0.

That is, a light-sensitive silver halide color photographic material, in which the spectral sensitization maximum of the red-sensitive layer thereof is at 600 to 630 mμ, and in which no deterioration in photographic characteristics and no change in the spectral sensitization maximum take place in the course of manufacturing said photographic material and during the storage thereof, is obtained by incorporating a combination of the aforesaid two kinds of sensitizing dyes into the red-sensitive layer of the multi-coated color photographic emulsion layers in said photographic material. By virtue of the use of such light-sensitive silver halide color photographic material as mentioned above, practically satisfactory reproduction of color is accomplished even when photographing is effected under changed light sources, for example, from day light to tungsten light or fluorescent lamp, and vice versa.

Representatives of the compounds [group (I)]of general formula (I) in the present invention may include, for example, those which are mentioned below.

(I-1)

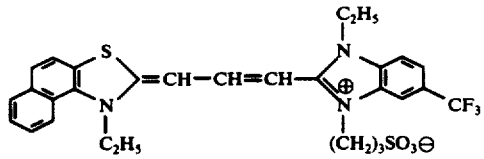

(I-2)

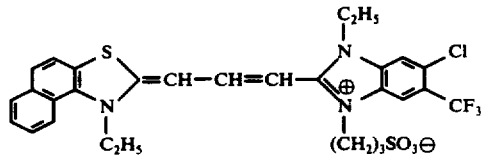

(I-3)

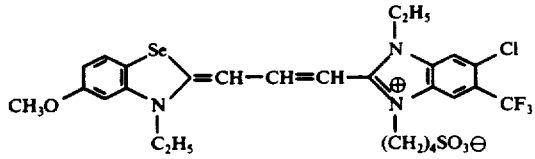

(I-4)

-continued

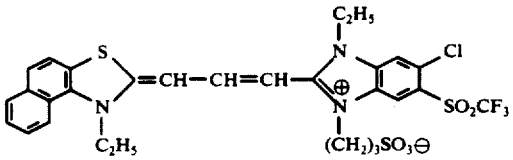

(I-5)

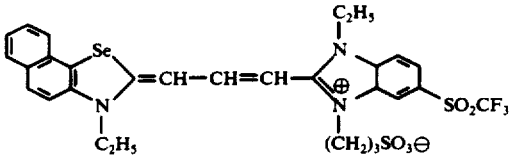

(I-6)

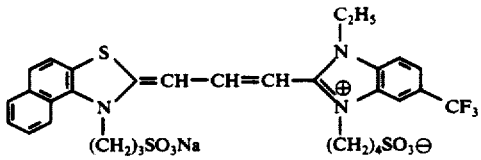

(I-7)

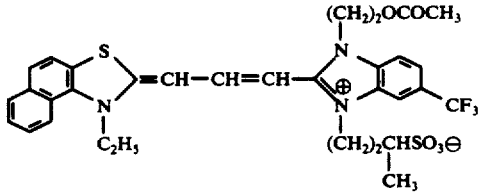

(I-8)

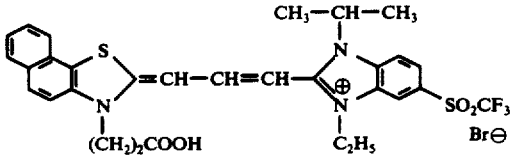

Further, representatives of the compounds [group (II)] of general formula (II) may include, for example, those which are mentioned below.

(II-1)

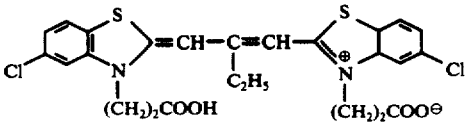

(II-2)

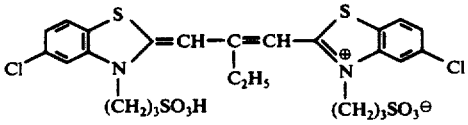

(II-3)

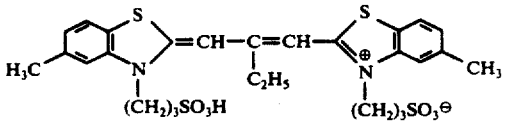

(II-4)

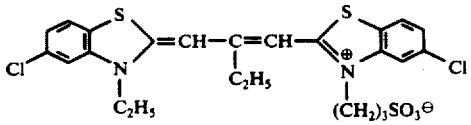

(II-5)

-continued

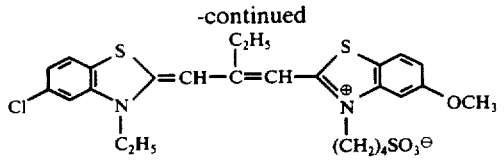

(II-6)

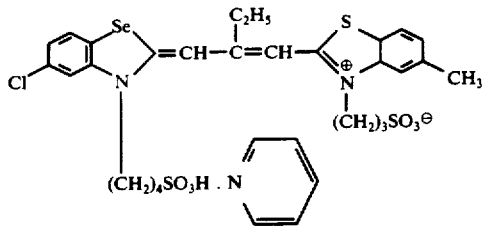

(II-7)

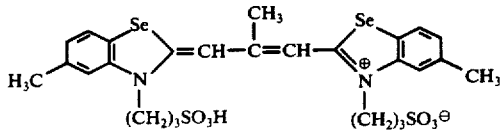

(II-8)

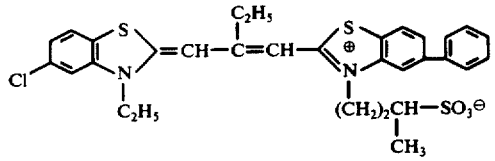

When the above-mentioned sensitizing dyes are used in combination, the ratio of the amount of a dye of general formula (I) to the amount of a dye of general formula (II) may be varied, according to a desired spectral sensitization maximum, within the range from 9:1 to 3:7 in weight. Further, the two kinds of sensitizing dyes according to the present invention may also be used in combination with other sensitizing dyes if necessary. For instance, when the necessity arises to further extend s spectral sensitization wavelength zone so as to include a longer wavelength zone, a sensitizing dye of the following structural formula may preferably be used in combination with the present two kinds of sensitizing dyes and, if necessary, a sensitizing dye different in structure for a shorter wavelength sensitization may further be used in combination therewith.

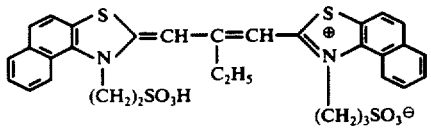

When a red-sensitive layer is sensitized, by the use of a combination of two kinds of sensitizing dyes of the present invention, to have its spectral sensitization maximum at such short wavelength as 600 mμ, it sometimes happens that the red-sensitive layer may have excessive green-sensitivity. In this case, it is preferred to provide a green light absorbing filter layer on the red-sensitive layer. Usually, magenta acid dyes are used in the said filter layer for achieving that purpose.

Further, in case such dyes tend to move from the filter layer to a silver halide emulsion layer by diffusion, it is preferable to use appropriate mordants, such as reaction products of carbonyl-containing polymers with aminoguanidine or salts thereof disclosed in U.S. Pat. No. 2,882,156, etc.

Incorporation of the sensitizing dyes of general formulas (I) and (II) of the present invention into a silver halide emulsion layer to be used for forming multi-coated color photographic emulsion layers may be carried out by that the dyes have been dissolved in an appropriate solvent, such as methyl alcohol, ethyl alcohol and tetrafluoropropanol. The amount of the sensitizing dyes to be incorporated is in the range of about between 28 mg 300 mg., per mole of silver halide, and said dyes may be incorporated into a silver halide emulsion during or at the end of the chemical ripening thereof.

Preferably useful as silver halide emulsions for forming the multi-coated color photographic emulsion layers according to the present invention, are those containing mixed silver halide such as silver iodobromide and silver chloroiodobromide.

Such the silver halide emulsion layer may be of more than two layers different in sensitivity due to different silver halide emulsions therefor or may include a mixture of different silver halide emulsion in order to improve photographic characteristics such as broader latitude for exposure.

As couplers used in the light-sensitive silver halide color photographic material of the present invention, which couplers react during color development with an oxidation product of an aromatic primary amino developing agent to form a dye, there may be mentioned, for example, phenol type, 5-pyrazolone type and open chain ketomethylene type compounds. The phenol type coupler which forms a cyan dye as a result of the reaction may include, for example, those which are mentioned below.

(C-1)

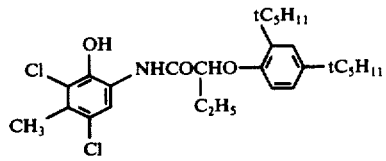

(C-2)

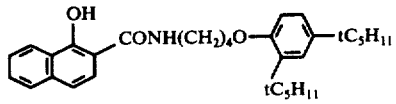

(C-3)

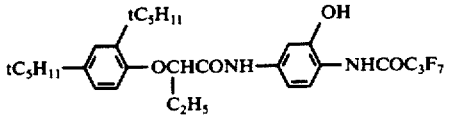

(C-4)

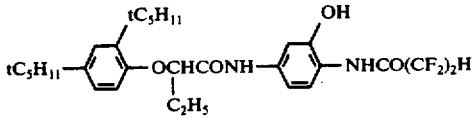

As the 5-pyrazolone type coupler for forming a magenta dye, there may be mentioned, for example, those which are shown below.

(M-1)

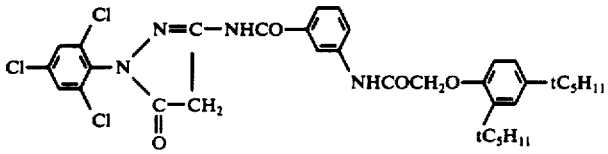

(M-2)

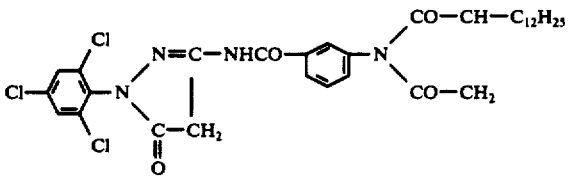

As the open chain ketomethylene type coupler, there may be mentioned, for example, those which are shown below.

(Y-1)

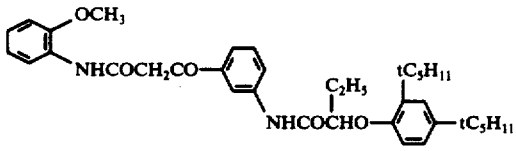

(Y-2)

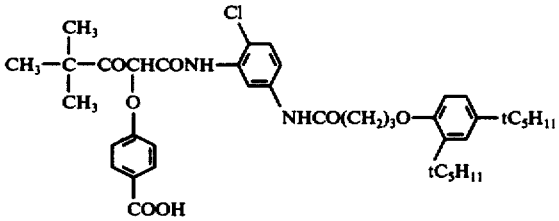

(Y-3)

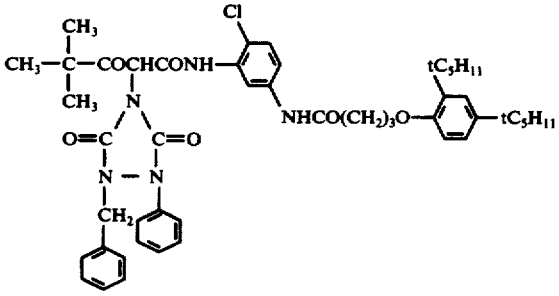

Further, in the application of such couplers to a light-sensitive silver halide negative color photographic material, if a colored coupler for automasking is used in combination therewith, there is no need of using the aforementioned magenta dye filter used on a red-sensitive layer of multi-coated color photographic emulsion layers.

Incorporation of the aforementioned couplers into a silver halide emulsion may be satisfactorily carried out by that the coupler is first dispersed in a high boiling organic solvent or dissolved in an alkali solution.

EXAMPLE 1

On a cellulose triacetate film base were provided an antihalation layer and a gelatin layer in this order. A red-sensitive silver halide emulsion was coated on the gelatin layer so that the amount of coated silver was 17 mg/100 cm². The silver halid used herein is a high speed silver iodobromide emulsion disclosed in Japanese Laid-Open-to-Public No. 65925/1973, which emulsion contains 6 mol% of silver iodide.

In this case, the silver halide emulsion was subjected to commonly adopted noble metal sensitization in addition to sulfur sensitization. The emulsion was further incorporated with, based on mole of silver halide contained in the emulsion, 65 mg. of compound (I-1) and 28 mg. of compound (II-2). The resulting emulsion was then incorporated with usual additives such as a stabilizer, a hardener and a coating aid and, further, incorporated with compound (C-2) as a cyan coupler so that the amount of the coupler was 12 mol% based on silver halide. On the resulting emulsion layer was provided a gelatine filter layer containing a magenta dye to prepare a sample (Sample No. 1).

Separately, the above-mentioned procedure adopted for preparing the sample was repeated, except that the sensitizing dyes, i.e. compound (I-1) and compound (II-2) were individually used alone to prepare control samples (Control samples Nos. 2 and 3), respectively.

The control sample and the sample thus prepared were individually exposed to light by means of a sensitometer using a spectrometer and a yellow filter and then processed according to the following processing steps with processing solutions as indicated below.

| Processing step | Processing time | Processing temperature |
|---|---|---|
| First development | 3 minutes | 38° C |
| First stopping | 0 minute 30 seconds | 38° C |
| Water washing | 1 minute | 38° C |
| Color development | 3 minutes 40 seconds | 43° C |
| Second stopping | 0 minute 30 seconds | 38° C |
| Water washing | 1 minute | 38° C |
| Bleaching A | 6 minutes | 38° C |
| Fixing | 6 minutes | 38° C |
| Water washing | 3 minutes | 38° C |
| Stabilization | 0 minute 30 seconds | 38° C |

In the above processing, when the bleaching step was carried out using a bleaching solution B mentioned later, the processing time employed was 1 minute 30 seconds. Further, pre-hardening and neutralization may be effected, if necessary, prior to the first development.

First developer:

| | |
|---|---|
| Sodium polyphosphate | 2.0 g |
| Sodium hydrogen sulfite (anhydride) | 8.0 g |
| Phenidon | 0.35 g |
| Sodium sulfite | 37.0 g |
| Hydroquinone | 5.5 g |
| Sodium carbonate | 33.0 g |
| Sodium thiocyanate (10% aqueous solution) | 13.8 ml |
| Sodium bromide | 1.3 g |
| Potassium iodide (0.1% aqueous solution) | 13.0 ml |
| Water to make | 1 liter |
| Adjusted to pH 9.9 ± 1. | |

First and second stopping solutions:

| | |
|---|---|
| Sodium hydroxide | 1.75 g |
| Glacial acetic acid | 30.0 ml |
| Water to make | 1 liter |
| Adjusted to pH 3.8. | |

Color developer:

| | |
|---|---|
| Sodium polyphosphate | 5.0 g |
| Benzyl alcohol | 4.5 g |
| Sodium sulfite | 7.5 g |
| Trisodium phosphate dodecahydrate | 36.0 g |
| Sodium bromide | 0.9 g |
| Potassium iodide (0.1% aqueous solution) | 90.0 ml |
| 4-amino-N-ethyl-N-(β-methanesulfoneamido-ethyl)-m-toluidine sesquisulfate monohydrate | 11.0 g |
| Ethyleneamine | 3.0 g |
| t-Butylaminoborane hydride | 0.07 g |
| Water to make | 1 liter |
| Adjusted with sodium hydroxide to pH 11.65 ± 0.1. | |

Bleaching solution A:

| | |
|---|---|
| Ferric ammonium EDTA | 170 g |
| Ammonium bromide | 300 g |
| Water to make | 1 liter |
| Adjusted to pH 5.8 - 6.0. | |

Bleaching solution B:

| | |
|---|---|
| Potassium ferricyanide | 165 g |

-continued

| | |
|---|---|
| Sodium bromide | 43 g |
| Water to make | 1 liter |
| Adjusted to pH 8.7 ± 0.15. | |

Fixing solution:

| | |
|---|---|
| Sodium thiosulfate (anhydride) | 94.5 g |
| Sodium hydrogen sulfite (anhydride) | 17.6 g |
| Sodium diphosphate (anhydride) | 15.0 g |
| Water to make | 1 liter |
| Adjusted to pH 5.9 ± 0.2. | |

Stabilizing solution:

| | |
|---|---|
| Polyoxyethylene ether | 0.15 g |
| Ethyl alcohol | 2.0 ml |
| Formaldehyde (37.5% solution) | 6.0 g |
| Water to make | 1 liter |

The sample (Sample No. 1) and control samples (Control samples Nos. 2 and 3) this processed were individually measured in speed and spectral sensitization maximum to obtain the results as shown in Table 1, and were further subjected to measurement by means of a spectrometer to obtain a spectrum graph as shown in the drawing.

Table 1

| Sample No. | Sensitizing dye | Spectral sensitization maximum mμ | Speed |
|---|---|---|---|
| Sample 1 | Compound (I-1) + compound (II-2) | 610 | 53 |
| Control sample 2 | Compound (I-1) | 580 | 10 |
| Control sample 3 | Compound (II-2) | 645 | 28 |

From Table 1 and the drawing, it is understood that the sample in which compound (I-1) was used in combination with compound (II-2) had its spectral sensitization maximum at 610 m as desired and was markedly sensitized in comparison with the control samples in which compound (I-1) and compound (II-2) were individually used alone.

EXAMPLE 2

On the surface of sample (Sample No. 1) of Example 1 were provided a green-sensitive emulsion layer and a yellow filter layer in this order. In this case, compound (M-1) was used as a coupler in the green-sensitive layer. On the resulting yellow filter layer were further provided successively a blue-sensitive emulsion layer and a protective layer and, in this case, compound (Y-2) was used as a coupler in the blue-sensitive layer. In thus provided red-sensitive, green-sensitive and blue-sensitive layers, the total amout of silver was 50 mg./100 $cm^2$. The thus obtained multi-coated color photographic emulsion layers was measured, according to the same procedure as in Example 1, in speed and spectral sensitization maximum to obtain very good results.

EXAMPLE 3

Into the red-sensitive silver halide emulsion layer of Example 1 without the sensitizing dyes used in the Example were incorporated, either singly or in combination, in the manner as shown in Table 2 with the compounds according to the present invention and the following comparative compounds (III-1) through (III-4)

to prepare samples (Samples Nos. 4 through 10) and control samples (Samples Nos. 11 through 24). The samples and control samples thus prepared were individually processed in the same manner as in Example 1 and then were individually measured in spectral sensitization maximum and speed of the red-sensitive layer to obtain the results as shown in Table 2.

Comparative compound:

(III-1)

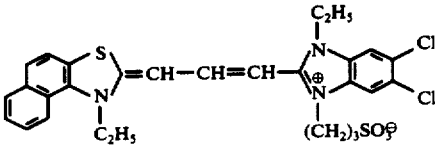

(III-2)

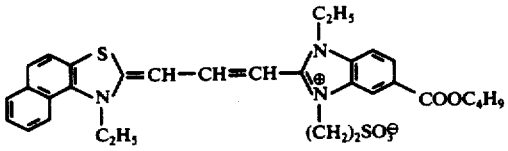

(III-3)

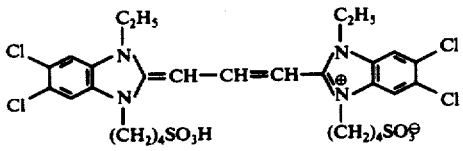

(III-4)

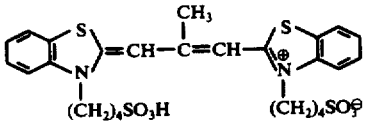

From Table 2, it is understood that the samples, in which compound (I) was used in combination with compound (II), individually had their spectral sensitization maximum at 600 to 630 mμ as desired and were markedly sensitized in comparison with the control samples in which compound (I) and compound (II) were individually used alone and the control samples in which comparative compound (III) was used.

EXAMPLE 4

Two kinds of sample emulsions were prepared in the same procedure as in Example 1, except that there was used, based on mole of silver halide, 28 mg. of compound (II-2) in combination with 65 mg of compound (I-1) or compound (I-2) in place of the sensitizing dyes used in Example 1.

From the two kinds of sample emulsions thus prepared, there were prepared samples (Sample Nos. 25 and 26), respectively. Each of the samples thus obtained includes one which was prepared by coating the sample emulsion, immediately after the preparation thereof, on a cellulose triacetate film base, and the other which was prepared by coating the sample emulsion, which emulsion has been stored, prior to coating, at 38° C. for 4 hours while slowly stirring.

Separately, the same procedure as above was repeated, except that 28 mg. of compound (II-2) was used in combination with comparative compound (III-1) to obtain a control sample (Sample No. 27). The samples and control sample thus obtained were individually measured in photographic characteristics such as spectral sensitization maximum and red-sensitivity to obtain results as shown in Table 3. Further, the said samples and control sample were individually measured in red-sensitivity when stored at 45° C. and RH 80% for 2 days to obtain the results as shown in Table 3.

Table 2

| Photographic characteristics Sample No. | Sensitizing Dye | Added amount (mg/AgX/mole) | Spectral sensitization maximum (mμ) | Sensitivity |
|---|---|---|---|---|
| 4 | Compound (I-1) + compound (II-1) | 28 + 65 | 620 | 56 |
| 5 | Compound (I-2) + compound (II-2) | 28 + 65 | 615 | 60 |
| 6 | Compound (I-2) + compound (II-3) | 28 + 65 | 620 | 55 |
| 7 | Compound (I-3) + compound (II-2) | 28 + 65 | 615 | 55 |
| 8 | Compound (I-4) + compound (II-1) | 28 + 65 | 615 | 50 |
| 9 | Compound (I-4) + compound (II-2) | 28 + 65 | 610 | 50 |
| 10 | Compound (I-5) + compound (II-3) | 28 + 65 | 625 | 58 |
| 11 | Compound (I-1) | 85 | 580 | 10 |
| 12 | Compound (I-2) | 85 | 590 | 15 |
| 13 | Compound (I-3) | 85 | 585 | 15 |
| 14 | Compound (I-4) | 85 | 595 | 16 |
| 15 | Compound (I-5) | 85 | 585 | 13 |
| 16 | Compound (II-1) | 28 | 650 | 43 |
| 17 | Compound (II-2) | 28 | 645 | 20 |
| 18 | Compound (II-3) | 28 | 650 | 45 |
| 19 | Comparative compound (III-2) | 85 | 580 | 8 |
| 20 | Comparative compound (III-3) | 85 | 590 | 10 |
| 21 | Comparative compound (III-4) | 85 | 560 | 7 |
| 22 | Compound (II-2) + comparative compound (III-2) | 28 + 65 | 640 | 40 |
| 23 | Compound (II-2) + comparative compound (III-3) | 28 + 65 | 645 | 30 |
| 24 | Compound (II-2) + comparatave compound (III-4) | 28 + 65 | 645 | 65 |

Table 3

| Photographic characteristics Sample No. | Sensitizing dye | Spectral sensitization maximum | | Red-sensitivity | | |
|---|---|---|---|---|---|---|
| | | Immediately after coating | Coating after storage | Immediately after coating | Coating after storage | Storage for 2 days 45° C., R.H. 80% after coating |
| 25 | Compound (II-2) + compound (I-1) | 610 | 610 | 53 | 50 | 48 |
| 26 | Compound (II-2) + compound (I-2) | 615 | 615 | 60 | 55 | 52 |

Table 3-continued

| Photographic characteristics Sample No. | Sensitizing dye | Spectral sensitization maximum: Immediately after coating | Spectral sensitization maximum: Coating after storage | Red-sensitivity: Immediately after coating | Red-sensitivity: Coating after storage | Red-sensitivity: Storage for 2 days 45° C., R.H. 80% after coating |
|---|---|---|---|---|---|---|
| 27 | Compound (II-2) + comparative compound (III-1) | 610 | 618 | 40 | 25 | 30 |

From Table 3, it is understood that the samples, in which compound (I) and compound (II) had been used, did not cause any change in spectral sensitization maximum, as compared with the control sample in which comparative compound (III) had been used. This is true even under unfavorable coating condition where the emulsion had been coated after stored for a certain period of time. Further the samples of the invention were very high in red-sensitivity and did not so decrease in red-sensitivity even when the emulsion had been coated after stored for a certain period of time and even when the samples were stored for a certain period of time under highly humid condition.

What we claim is:

1. A light-sensitive silver halide color photographic material comprising at least a support and a red-sensitive, silver halide-containing layer which comprises at least one sensitizing dye of the following general formula (I)

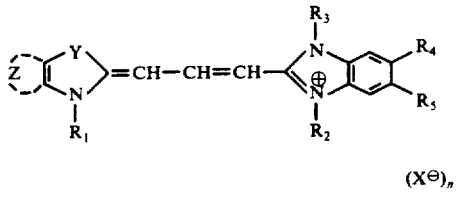

(I)

wherein Z is a non-metallic atom group necessary to form a non-substituted naphthalene and a non-substituted or alkoxy-substituted benzene ring; Y is sulfur or selenium; $R_1$ and $R_2$ are individually alkyl, sulfoalkyl, carboxy alkyl, alkoxy alkyl, hydroxy alkyl or aralkyl; $R_3$ is alkyl, acyloxyalkyl, aryl or aralkyl and at least one of $R_1$ and $R_2$ is carboxyalkyl or sulfoalkyl; $R_4$ is hydrogen or halogen; $R_5$ is trifluoroalkyl or trifluoroalkylsulfonyl; X is an anion and $n$ is zero or 1, and an inner salt is formed when $n$ is zero; and at least one sensitizing dye of the following general formula (II)

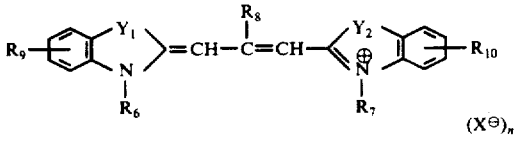

(II)

wherein $Y_1$ and $Y_2$ are individually sulfur or selenium; $R_6$ and $R_7$ are individually a substituent selected from the same groups as defined as to $R_1$ and $R_2$; and at least one of $R_6$ and $R_7$ is carboxyalkyl or sulfoalkyl; $R_8$ is lower alkyl; $R_9$ and $R_{10}$ are individually hydrogen, halogen, alkyl, alkoxy or aryl; X is an anion and $n$ is zero or 1, provided that an inner salt is formed when $n$ is zero.

2. A photographic material according to claim 1, wherein the amount ratio of the sensitizing dye of general formula (I) to the sensitizing dye of general formula (II) in the layer is in a range of 9:1 to 3:7 by weight.

3. A photographic material according to claim 1, wherein the silver halide is mixed silver halide.

4. A photographic material according to claim 1, wherein the sensitizing dyes are individually present in the red-sensitive layer in an amount of about between 28 and 300 mg per mole of silver halide.

5. A photographic material according to claim 1, wherein the red-sensitive layer has spectral sensitization maximum at 600 to 630 mμ.

6. A photographic material according to claim 1, wherein the sensitizing dye of general formula (I) is an inner salt, Z being non-substituted naphthalene and benzene having alkoxy, Y being sulfur or selenium, $R_1$ and $R_3$ being individually alkyl, $R_2$ being sulfoalkyl, $R_4$ being hydrogen or halogen, $R_5$ being trifluoroalkyl, and $n$ being zero in the formula.

7. A photographic material according to claim 6, wherein alkyl in $R_1$ and $R_3$ is ethyl, sulfoalkyl in $R_2$ being sulfopropyl or sulfobutyl, halogen in $R_4$ being chlorine, trifluoroalkyl in $R_5$ being trifluoromethyl, and alkoxy attached to the benzene in Z being methoxy.

8. A photographic material according to claim 1, wherein the sensitizing dye of general formula (II) is an inner salt, $Y_1$ and $Y_2$ being individually sulfur, $R_6$ being alkyl, carboxyalkyl or sulfoalkyl, $R_9$ and $R_{10}$ being individually halogen or alkyl, $R_8$ being lower alkyl, $R_7$ being sulfoalkyl or carboxyalkyl, and $n$ being zero.

9. A photographic material according to claim 8, wherein halogen and alkyl in $R_1$ and $R_{10}$ are respectively chlorine and methyl, alkyl in $R_6$ being ethyl, carboxyalkyl in $R_6$ and $R_7$ being carboxyethyl, sulfoalkyl in $R_6$ and $R_7$ being sulfoxypropyl, and lower alkyl in $R_8$ being ethyl.

10. A photographic material according to claim 9, wherein the sensitizing dye of general formula (I) is an inner salt, Z being non-substituted naphthalene or benzene having alkoxy, Y being sulfur or selenium, $R_1$ and $R_3$ being individually ethyl, $R_2$ being sulfopropyl or sulfobutyl, $R_4$ being hydrogen or chlorine, $R_5$ being trifluoromethyl, and $n$ being zero in the formula.

11. A photographic material according to claim 1, wherein the layer further comprises a cyan coupler.

* * * * *